United States Patent [19]

Arito et al.

[11] Patent Number: 4,712,905

[45] Date of Patent: Dec. 15, 1987

[54] METHOD OF PREVENTING THE OCCURRENCE OF BLACKENED MARGINS ON PHOTOSENSITIVE SHEETS IN ELECTROPHOTOGRAPHY

[75] Inventors: Tatsunari Arito; Yu Tojo, both of Kanagawa, Japan

[73] Assignee: Fuji Photo Film Co., Ltd., Kanagawa, Japan

[21] Appl. No.: 792,694

[22] Filed: Oct. 15, 1985

[30] Foreign Application Priority Data

Oct. 15, 1984 [JP] Japan ..... 59-214180

[51] Int. Cl.[4] ..... G03G 15/048

[52] U.S. Cl. ..... 355/3 CH; 355/14 R; 355/14 CH; 430/902

[58] Field of Search ..... 355/3 CH, 3 TE, 3 R, 355/14 R, 14 CH, 13; 430/902

[56] References Cited

U.S. PATENT DOCUMENTS

| | | | |
|---|---|---|---|
| 3,612,682 | 6/1968 | Shelffo | 355/14 R |
| 3,724,940 | 4/1973 | Koizumi | 355/3 R |
| 3,799,666 | 3/1974 | Fukushima et al. | 355/3 R |
| 3,901,593 | 8/1975 | Kogiso et al. | 355/3 R X |
| 4,239,371 | 12/1980 | Igarashi et al. | 355/13 X |
| 4,382,674 | 5/1983 | Miyoshi et al. | 355/3 CH |
| 4,396,275 | 8/1983 | Oka et al. | 355/14 R |
| 4,591,262 | 5/1986 | Oseto et al. | 355/3 CH X |
| 4,653,008 | 3/1987 | Kai et al. | 355/14 SH X |

*Primary Examiner*—Arthur T. Grimley
*Assistant Examiner*—Jane K. Lau
*Attorney, Agent, or Firm*—Young & Thompson

[57] ABSTRACT

A method of preventing the occurrence of blackened margins on a photosensitive sheet processed in an electrophotographic apparatus. The method comprises the steps of calculating a first sheet transporting length by which the photosensitive sheet is required to be transported until the forward end of an image area of the photosensitive sheet within which an image is allowed to be formed is charged with electricity and a second sheet transporting length by which the sheet is required to be further transported until the rear end of the image area is charged with electricity. A charging device is caused to turn ON when the actually transported length of the photosensitive sheet attains the calculated first sheet transporting length, and then is deactuated to turn OFF when the additionally transported length of the photosensitive sheet attains the calculated second sheet transporting length. Thus the photosensitive sheet can be charged with electricity only in its image area regardless of the overall length of the photosensitive sheet and of the position in which the photosensitive sheet is placed for exposure to the image-forming light. As a result, the margins of the photosensitive sheet, although they have not been exposed to the image-forming light or to erasing light, nevertheless attract no toner particles and so are not blackened.

5 Claims, 3 Drawing Figures

METHOD OF PREVENTING THE OCCURRENCE OF BLACKENED MARGINS ON PHOTOSENSITIVE SHEETS IN ELECTROPHOTOGRAPHY

BACKGROUND OF THE INVENTION

1. Field of the Invention

The present invention relates to a method of preventing the occurrence of blankened margins on photographic sheets used in electrophotographic apparatus such as electrophotographic lithoplate-making machines, electrophotocopying machines and the like in which an image of a document is formed by an electrophotographic method on a photosensitive sheet.

2. Description of the Prior Art

As is well known in, for example, electrophotographic lithoplate-making machines, a photosensitive sheet with at least an electrophotosensitive material layer formed thereon is used as a master paper. The photosensitive sheet is, after being charged with electricity by a charger, transported to and placed in exposure position for being exposed to image-forming light. The regions of the photosensitive sheet exposed to the image-forming light are discharged, so that an electrostatic latent image is formed on the photosensitive sheet. The photosensitive sheet on which the electrostatic latent image has been formed is then developed and fixed in a well known manner. As a result of this, the regions exposed to no image-forming light permit toner particles to adhere thereto so as to form a visible image corresponding to the pattern of the electrostatic latent image. The remaining regions, exposed to the image-forming light do not permit toner particles to adhere thereon. The photosensitive sheet is finished in such a way that, by use of an etcher, the part with toner particles adhered is caused to be oleophilic and the remaining part to which no toner particles adhered is rendered hydrophilic. The finished photosensitive sheet is later used as a printing plate, which is fastened around the rotary cylinder of a printing machine for printing with oil inks.

Either when a photosensitive sheet having a length longer than a regular one is used or when a photosensitive sheet is placed in a different position from the specified position in order to form an image offset to one side of the photosensitive sheet, the photosensitive sheet is obliged to include parts, especially margins, where no image-forming light shines. This leads to the occurrence of blackened margins on the photosensitive sheet, which is very undesirable.

For preventing the occurrence of blackened margins, heretofore, an eraser device having a lamp unit has been used and alternatively, a lens system having a large angle of view has been used so as to shine on a widened exposure area.

A problem associated with conventional electrophotographic apparatus is that in the former the provision of a special eraser device increases the production cost of the apparatus.

Another problem associated with conventional apparatus is that in the latter alternative, the widened exposure area requires scaling up of the machinery.

OBJECTS OF THE INVENTION

Accordingly, an object of the present invention is to provide a method which can prevent the occurrence of blackened margins on an electrophotographically finished photosensitive sheet.

Another object of the present invention is to provide a method for preventing the occurrence of blackened margins whilst neither increasing production cost nor scaling up the electrophotographic apparatus for use in the method.

SUMMARY OF THE INVENTION

For accomplishing these and other objects, according to the present invention, a method of preventing the occurrence of blackened margins on a photosensitive sheet finished in electrophotographic apparatus comprises the steps of calculating a first transporting length by which the photosensitive sheet is required to be transported by sheet transporting means until the forward end of an image area of the photosensitive sheet wherein an image is to be formed is charged with electricity by charging means and a second transporting length by which the photosensitive sheet is required to be further transported by the sheet transporting means until the rearward end of the image area is charged with electricity by the charging means, causing the charging means to turn ON when the photosensitive sheet is transported by the first transporting length by the transporting means during its transportation, and deactuating the charging means to turn OFF when the photosensitive sheet is further transported by the second transporting length by the transporting means during its transportation. The first and second transporting lengths can be calculated by specifying the length of the photosensitive sheet and the length between the center of the exposure area and the trailing end of the photosensitive sheet. By turning the charging means ON and OFF in this way, the outside of the image area of the photosensitive sheet can be prevented from being charged with electricity, so that even though the outside of the image area of the photosensitive sheet is not exposed to either image-forming light or erasing light, there is not produced any blackened margin on the photosensitive sheet.

BRIEF DESCRIPTION OF THE DRAWINGS

For a fuller understanding of the nature and objects of the invention, reference should be had to the following detailed description taken in connection with the accompanying drawings wherein.

DETAILED DESCRIPTION OF THE INVENTION

Figure 1:
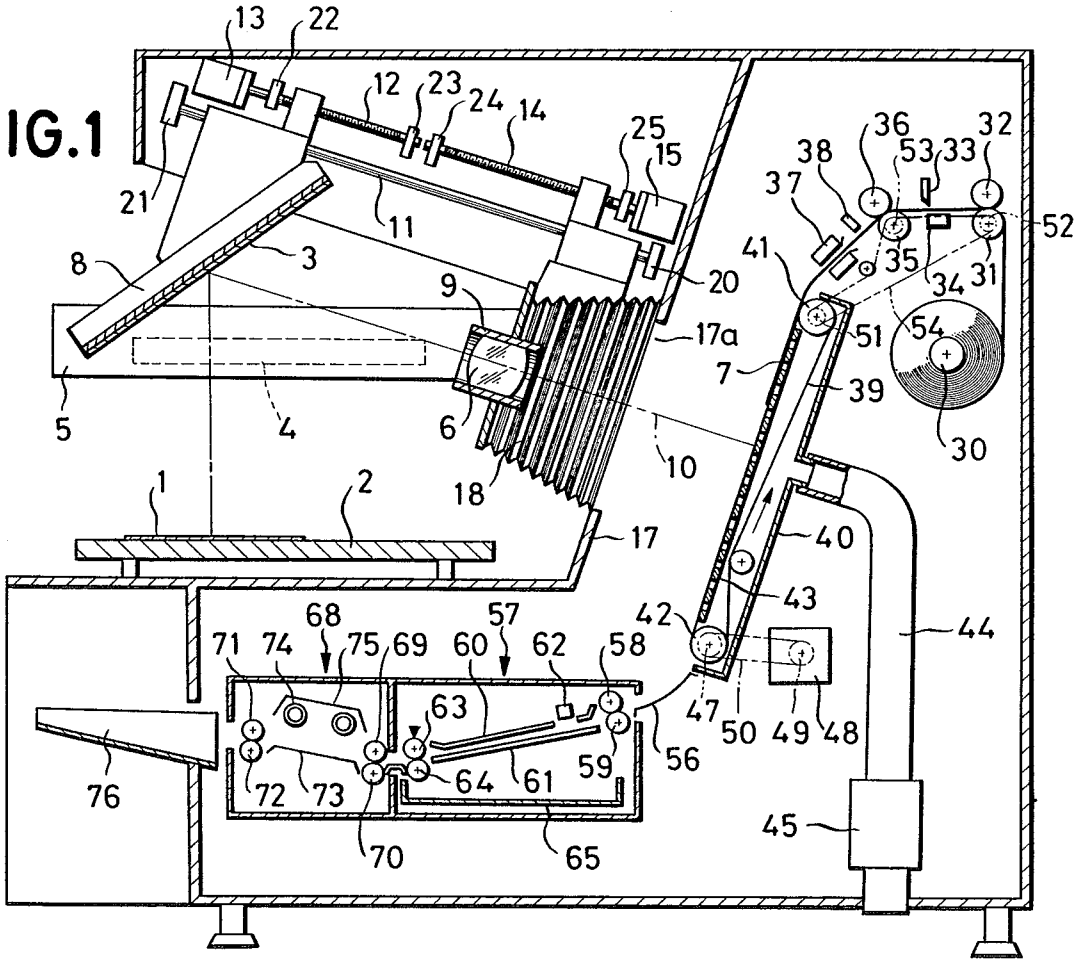
FIG. 1 is a sectional view showing a camera-type electrophotographic lithoplate-making machine for use in the method according to the present invention.

Referring now to FIG. 1, shown therein is a camera-type electrophotographic lithoplate-making machine which includes a mirror 3 above the stage 2 on which a document 1 is placed. On both sides of the mirror 3 there are provided elongated light sources 4 which are supported on arms 5 respectively. Imageforming light from the document 1 is reflected by the mirror 3 and directed back to the objective lens 6 which can focus an image of the document on a photosensitive sheet 7 at an exposure position in the machine.

The mirror 3 and the objective lens 6 are supported on holders 8, 9, respectively, which are mounted on a guide bar 11 disposed parallel to the optical axis 10 of the objective lens 6 for axial movement in order to change image magnification. The mirror holder 8 is threadingly engaged by a screw shaft 12 which is coupled to a stepping motor 13 so as to controllably provide an axial movement of the mirror 3 in either direction. The lens holder 9 is also threadingly engaged by screw shaft 14 which is coupled to another stepping motor 15 so as to controllably provide an axial movement of the objective lens 6 in either direction. Since a desired image distance can be obtained absolutely from the formulas of lens and magnification when magnification is given, the objective lens 6 is moved axially by the stepping motor 15 so as to be positioned at a distance equal to the resulting image distance. As an object distance can be given as a function of image distance, the mirror 3 is moved by the stepping motor 13 in accordance with the resulting distance. In practice, there is provided a table memory which contains the relationship between magnification and the numbers of pulses in proportion to which the stepping motors causes axial movement of the objective lens 6 and the mirror 3 relative to a reference position thereof. The direction of rotation of the stepping motors and can be decided from the difference between the respective numbers of pulses corresponding to a present and a desired magnification. The number of pulses equal to the difference is then supplied to the stepping motors.

Provided between the lens holder 9 and a front panel 17 is a bellows 18 which defines the passage for the image-forming light between the objective lens 6 and the opening 17*a* formed in the front panel 17. Designated at 20 to 25 in FIG. 1 are bearings for supporting the guide bar 11 and the screw shafts 12, 14.

The photosensitive sheet 7 would around the supply roller 30 is fed by a pair of feed rollers 31, 32 to a cutting station where a cutter comprising a stationary cutting blade 34 and a movable cutting blade 33 is disposed for cutting the sheet 7 to a certain predetermined length in accordance with the size of a printing cylinder of the printing machine to be used. The length of photosensitive sheet thus cut is transported by a pair of transporting rollers 35, 36 toward a charger 37 for charging the surface of the sheet with electricity. A reflection-type sensor 38 comprising a light emitter and a light receiver is provided for the purpose of detecting the passage of the leading end of the photosensitive sheet 7. After passing the charger 37, the photosensitive sheet 7 is attracted by and held on a suction belt 39 with a large number of suction holes so as to be transported to an exposure station. It is desirable to provide a plurality of suction belts 39 stretched between rollers 41, 42 disposed in a suction box 40 in communication with a suction blower 45 through a conduit 44. For maintaining the flatness of the suction belts 39, there is provided a perforated plate 43 therebehind.

Coaxially attached to the roller 42 is a pulley 47 which is connected through a belt 50 to a driving pulley 49 mounted on the shaft of a stepping motor 48 so that the pulley 47 is rotated. The rollers 41, 31, 35 are provided with respective pulleys 51, 52, 53 coaxially therewith which are connected by a belt 54 so as to rotate at a same rate. However, between the feed roller 31 and the pulley 52 there is provided a magnetic clutch (not shown) so the the feed rollers 31, 32 stop just after the cutter has operated.

The photosensitive sheet 7 is transported to the developing station 57 by a guide member 56 after exposure at the exposure station. There are disposed in the developing station 57 a pair of feed rollers 58, 59, upper and lower electrode plates 60, 61 opposite to each other, developing solution supplying nozzle 62, a pair of squeeze rollers 63, 64 and a develping solution reservoir 65.

The developed sheet 7 is then transported to the fixing station 68 for thermal fixation. In the fixing station 68, there are disposed a pair of feeding rollers 69, 70, a pair of forwarding rollers 71, 72, a guide plate 73 between the feeding and forwarding rollers, and a heater 74 with a heat reflector 75 over the guide plate 73. At this station, that developed sheet 7 is thermally fixed and transported toward a receptor 76.

In making an electrophotograph, the data representative of image magnification are entered into a keyboard (not shown) to produce the movement of the mirror 3 and objective lens 6 relative to each other according to the desired magnification. When an exposure switch is actuated for exposure, the rotation of the stepping motor 48 is caused so as to move the suction belt 39 in the direction shown by the arrow. In cooperation with the suction belt 39, the feed rollers 31, 35 are forced to rotate so as to withdraw the photosensitive sheet 7 from the supply roller 30. The leading end of the photosensitive sheet 7 which is in the cutting position can be transported by the rollers 35, 36 to reach the top of the suction belt 39 after passing the sensor 38. When a predetermined length of the photosensitive sheet 7 is transported, the movable cutting blade 33 is activated to cut the photosensitive sheet 7. After cutting the photosensitive sheet 7, the feed roller 31 is stopped as a result of the actuation of the magnetic clutch.

The photosensitive sheet 7 thus cut is, as described in detail later, charged with electricity by the charger 37 while being transported by a certain length after passing the sensor 38 so as to render the photosensitive sheet 7 electrophotosensitive.

The charger 37 is, as described in detail later, turned ON when the photosensitive sheet 7 thus cut is transported by a certain length just after the leading end thereof has passed the sensor 38, and then turned OFF when transported by another certain length, so as to charge only the area of the photosensitive sheet 7 in which an image is to be formed.

Figure 2:
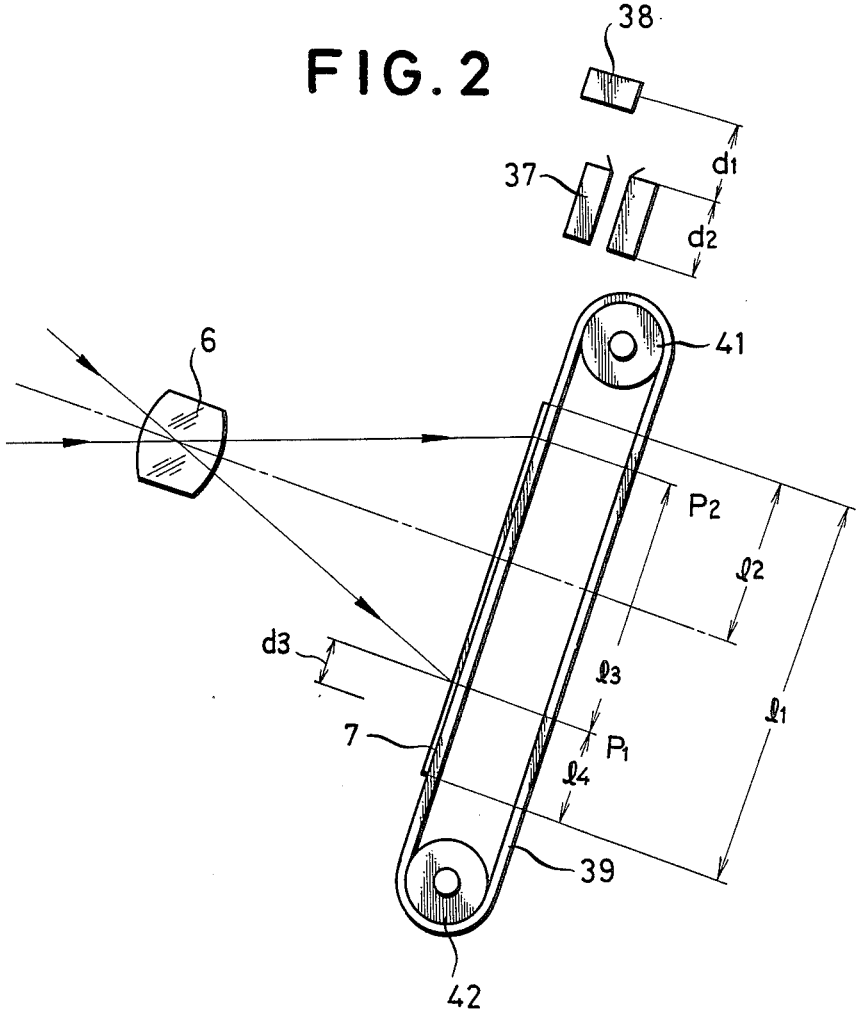
FIG. 2 is an illustrative view for explaining the present invention wherein a photosensitive sheet is placed in exposure position.

When stepping motor 48 rotates a certain amount which causes adding the distance between the cutter and the center of the exposure station to the length $(l_1-l_2)$ as shown in FIG. 2, the suction belt 39 conveys the photosensitive sheet 7 so as to place the charged photosensitive sheet 7 in position for exposure. The light sources 4 are caused to illuminate the document 1 for a certain period of time. During this illumination, the charged photosensitive sheet 7 is exposed to the image-forming light reflected from the document passing through the objective lens 6 in a well known manner so as to form an electrostatic latent image thereon. After this exposure, the stepping motor 48 is started again in order to transport another photosensitive sheet cut to a certain length to the exposure station while sending the exposed photosensitive sheet 7 to the developing station 57 where developing solution ejected from the nozzle 62 is sprayed on the exposed photosensitive sheet 7 to which the electirc field is applied by means of the upper and lower electrode plates 60, 61. After this, the developed photosensitive sheet 7 is fed to the fixing station for thermal fixation by the heater 74. As a result of thermal fixation, the toner particles adhere to the part of the photosensitive sheet 7 which has not been exposed to the image-forming light, and do not adhere to the remaining part of the photosensitive sheet 7, that is to say, the part having been exposed to the image-forming light.

Reference is now had to FIG. 2 for explaining the relationship between the moving distances of the photosensitive sheet and the operation of the charger. For the purpose of simplicity of explanation, various symbols are used to designate specific dimensions, namely:

$d_1$ for the distance between the sensor 38 and the charger 37, $d_2$ for the width of the charger 37 in the direction of transportation of the photosensitive sheet 7, $d_3$ for the distance by which the photosensitive sheet 7 is transported during the period of time from the acutation of the charger 37 to the actual charging of the photosensitive sheet with electricity thereby. Thus, if v is the velocity of movement of the sheet 7 and t the transition time of the charger 37, then $d_3$ is equal to $v \times t$, $l_1$ for the length of the photosensitive sheet 7, which is fixed in accordance with the kind of offset press used, $l_2$ for the length of that part of the sheet 7 between the center of an image area (coincident with the optical axis of the objective lens 6) and the trailing end of the photosensitive sheet 7, and $l_3$ for the distance between the forward and rearward positions $P_1$ and $P_2$ on the photosensitive sheet 7 by which an actual image area is defined.

The time of the actuation of the charger 37 and the interval over which the charger 37 is kept active can be found by referring to the lengths between the leading end of the photosensitive sheet 7 and the position $P_1$ on the photosensitive sheet 7, which is the forward end of the image area, and between the leading end of the photosensitive sheet 7 and the position $P_2$ on the photosensitive sheet 7, which is the rear end of the image area. Specifically, both of the lengths are adjusted with the known values $d_1$, $d_2$ and $d_3$ determined according to the location of the charger 37 and the delay time of operation of the charger 37.

Meanwhile, in the offset press, the length $l_1$ is fixed according to the rotary cylinder, and the length $l_2$ is fixed so as to use it as a standard to determine the print position on the paper. If the lengths $l_1$ and $l_2$ are fixed, the photosensitive sheet 7 is properly located at the exposure station as shown in FIG. 2, because the distance from the cutter to the center of the exposure station is predetermined by the mechanical design. Then, in the above-mentioned type of elctrophotographic lithoplate-making machine, only the lengths $l_1$ and $l_2$ can be designated. The length $l_3$ can be obtained based on characteristics of the objective lens 6 to be used when the magnification of the image is indicated. By reason of this, the lengths of positions $P_1$ and $P_2$ relative to the leading end of photosensitive sheet 7 are determined corresponding to the length $l_1$, $l_2$ and $l_3$. Therefore, according to the present invention, the following equation (1) is used to obtain a first transporting length L1 by which the photosensitive sheet 7 is moved until the charger 37 is turned ON after the detection of the leading end of the photosensitive sheet 7:

$$L1 = l_1 - l_2 - (l_3/2) + d_1 - d_3 \quad (1)$$

On the other hand, the following equation (2) is used to obtain a second transporting length L2 by which the photosensitive sheet 7 is moved until the charger 37 is turned OFF after the turning on thereof:

$$L2 = l_3 + d_2 + d_3 \quad (2)$$

The first and second transporting lengths can be calculated by means of a microcomputer and the above equations and each actual length by which the photosensitive sheet 7 has been moved can be measured by either counting the pulses which are supplied to the stepping motor 48 after the provision of a detection signal from the sensor 38 or detecting the amount of rotation of a transporting roller with a rotary encoder well known per se.

Figure 3:
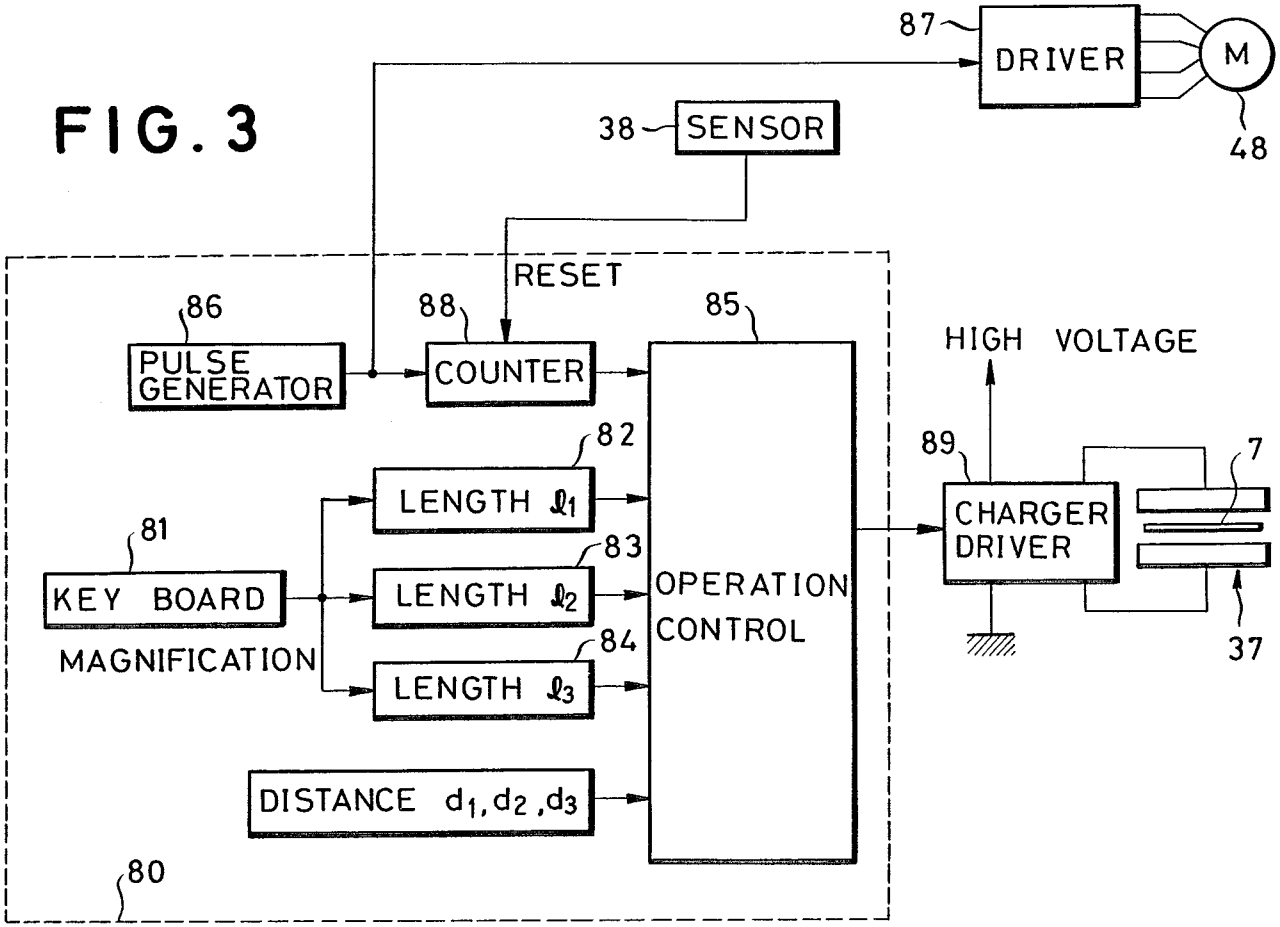
FIG. 3 is a block diagram showing the function of the microcomputer for controlling the operation of a charger.

Referring now to FIG. 3 showing in a block diagram form the function of microcomputer 80, the data representative of the lengths $l_1$ and $l_2$ of the photosensitive sheet 7 to be used as a printing plate are memorized in RAMs 82 and 83 by operating the keyboard 81. On the other hand, when the data representative of a desired magnification of image is entered into the keyboard 81, the length $l_3$ is calculated in the operation control 84. The respective distances $d_1$, $d_2$ and $d_3$, which are peculiar to the machine and previously known, have been memorized as supplementary data in ROM 90. In the operation control 85, the first and second transporting length L1 and L2 are calculated from the equations (1), (2), using the given data.

A pulse generator 86 provides driving pulses which are fed to a driver 87 so as to cause the stepping motor 48 to rotate through one step for each driving pulse, whereby the photosensitive sheet 7 is transported under control. In the course of the transportation of the photosensitive sheet 7, the sensor 38, upon optically detecting the leading end of the photosensitive sheet 7, resets the counter 88 and causes it to count the driving signals or pulses for the measurement of the transported length of the photosensitive sheet 7. When the count of the counter 88 reaches the value corresponding to the first transporting length L1, a driver 89 is actuated to apply a high voltage to the charger 37. Subsequently, when the count of the counter 88 reaches the value corresponding to the total of the first and second transporting lengths L1 and L2, the driver 89 is deactuated. As a result of such controlled operation, the charger 37 can charge a desired image area of the photosensitive sheet 7 with electricity, without charging the outside of the image area with any electricity.

Because certain changes may be made in the above-described improved method without departing from the scope of the invention herein disclosed, it is intended that all matter contained in the above description of shown in the accompanying drawings shall be interpreted as illustrative and not in a limiting sense.

What is claimed is:

1. A method of charging a photosensitive sheet with electricity by charging means disposed before an exposure position in an electrophotographic apparatus while the photosensitive sheet is transported toward the exposure position by transporting means so as to render the photosensitive sheet electrophotosensitive, said method comprising the steps of:

determining on the basis of the extent of an image area of said photosensitive sheet a first transporting length by which said photosensitive sheet is to be moved until a forward end of the image area of said photosensitive sheet within which an image can be formed is charged with electricity by said charging means after the arrival of a leading end of said photosensitive sheet at a specified position and a second transporting length by which the photosensitive sheet is to be further transported until a rear end of said image area of said photosensitive sheet is charged with electricity by said charging means;

actuating said charging means to turn ON upon said photosensitive sheet having been transported by said first transporting length by said transporting means; and deactuating said charging means to turn OFF upon sid photosensitive sheet have been transported by said second transporting length by said transporting means, thereby preventing any area of said photosensitive sheet which is not part of the image area from being charged with electricity so as to prevent blackened margins on the photosensitive sheet.

2. A method as defined in claim 1, wherein said photosensitive sheet is detected by a sensor which is disposed before said charging means upon passing by said sensor, whereby said arrival of the leading end of said photosensitive sheet at said specified position is detected.

3. A method as defined in claim 2, wherein said first transporting length (L1) and second transporting length (L2) are calculated from the following equations, respectively:

$$L1 = l_1 - l_2 - (l_3/2) + d_1 - d_3$$

$$L2 = l_3 + d_2 + d_3$$

where $d_1$ is the distance between the sensor and charging means;

$d_2$ is the width of the charging means in the forward direction;

$d_3$ is the distance by which the photosensitive sheet is transported until the charging means is enabled to charge the photosensitive sheet with electricity;

$l_1$ is the overall length of the photosensitive sheet;

$l_2$ is the length between a trailing end of the photosensitive sheet and the center of the exposure station in which the photosensitive sheet is positioned; and $l_3$ is the effective image length corresponding to the distance between the forward and rear ends defining an image area exposed to image-forming.

4. A method as defined in claim 3, wherein said transporting means comprises pulse generating means and a stepping motor driven by driving pulses fed thereto from said pulse generator means so as to transport said photosensitive sheet a distance corresponding to the numbers of driving pulses.

5. A method as defined in claim 4, wherein the transported length of said photosensitive sheet is measured by counting the driving pulses fed to said stepping motor, said pulse counting being effected by a counter which is associated with said sensor so as to be reset when said sensor detects said arrival of the leading end of the photosensitive sheet at said specified position.

* * * * *